US008314557B2

(12) United States Patent
Ito et al.

(10) Patent No.: US 8,314,557 B2
(45) Date of Patent: Nov. 20, 2012

(54) LIGHT SOURCE DEVICE, DISCHARGE LAMP AND ITS CONTROL METHOD

(75) Inventors: Yoshinobu Ito, Hamamatsu (JP); Koji Matsushita, Hamamatsu (JP); Masaki Ito, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 268 days.

(21) Appl. No.: 12/666,512

(22) PCT Filed: May 2, 2008

(86) PCT No.: PCT/JP2008/058424

§ 371 (c)(1),
(2), (4) Date: Dec. 23, 2009

(87) PCT Pub. No.: WO2009/001616

PCT Pub. Date: Dec. 31, 2008

(65) Prior Publication Data

US 2010/0181912 A1 Jul. 22, 2010

(30) Foreign Application Priority Data

Jun. 28, 2007 (JP) ..... 2007-170702

(51) Int. Cl.
*H01J 13/46* (2006.01)

(52) U.S. Cl. ..... 315/56; 315/94; 315/107

(58) Field of Classification Search ..... 315/46, 315/48, 50, 56, 94, 106–107, 115–117; 313/613
See application file for complete search history.

(56) References Cited

U.S. PATENT DOCUMENTS

| | | | | |
|---|---|---|---|---|
| 5,057,742 | A * | 10/1991 | Kawai et al. | 313/623 |
| 5,646,487 | A * | 7/1997 | Ikedo et al. | 315/94 |
| 5,684,363 | A * | 11/1997 | Ikedo et al. | 313/613 |
| 5,698,945 | A * | 12/1997 | Ikedo et al. | 313/613 |
| 6,850,008 | B2 * | 2/2005 | Clark | 313/613 |

FOREIGN PATENT DOCUMENTS

| | | |
|---|---|---|
| JP | 53-128173 | 11/1978 |
| JP | 56-29359 | 7/1981 |
| JP | 61-24195 | 2/1986 |
| JP | 61-32346 | 2/1986 |
| JP | 62-14698 | 1/1987 |
| JP | 2004-519077 | 6/2004 |

* cited by examiner

*Primary Examiner* — Tung X Le
(74) *Attorney, Agent, or Firm* — Drinker Biddle & Reath LLP

(57) ABSTRACT

At an initial stage of a discharge start, a shield electrode is connected to a ground potential via a bidirectional voltage trigger switch. Thereafter, when an electrical charge within the shield electrode flows to the ground potential, by being triggered with this potential, both terminals of the bidirectional voltage trigger switch are disconnected therebetween. Thus, at an initial stage of discharge, charging of the shield electrode is suppressed to suppress a decline in discharge, and in a sustained discharge, destabilization due to an unwanted discharge from the shield electrode to the anode can be suppressed, and using such an electrode automatically allows improving the lighting performance of a discharge lamp.

9 Claims, 16 Drawing Sheets

LIGHT SOURCE DEVICE, DISCHARGE LAMP AND ITS CONTROL METHOD

TECHNICAL FIELD

The present invention relates to a light source device, a discharge lamp, and its control method.

BACKGROUND ART

Conventionally, discharge lamps such as deuterium lamps are known. A discharge lamp disclosed in Patent Document 1 is disposed with a cathode, an anode, an aperture member, and a shield electrode in a sealed vessel filled with gas, and forms a discharge between the cathode and anode. The cathode is formed of a filament, and thermal electrons generated by conduction of electricity to the filament lead into an opening of the aperture member through an opening of the shield electrode, and are collected by the anode. In the vicinity of the opening of the aperture member, gas particles charged by thermal electrons emit light, and the emitted light is output to the outside via a sidewall of the sealed vessel.

Patent Document 1: Japanese Translation of International Application No. 2004-519077

DISCLOSURE OF THE INVENTION

Problem to be Solved by the Invention

However, in conventional discharge lamps, the lighting performance was inferior in some cases, and the cause for this has been unknown.

The present invention has been made in view of such a problem, and an object thereof is to provide a light source device, a discharge lamp, and its control method that allow improving the lighting performance.

Means for Solving the Problem

As a result of intensive studies conducted by the inventors of the present application for solving the above-described problem, the cause has been discovered as below. That is, when the potential of the shield electrode is provided as a floating potential, thermal electrons from the cathode accumulate in the shield, and the potential of the shield electrode results in a negative potential. In this case, the amount of thermal electrons leading from the cathode to the aperture member declines, which hinders satisfactory lighting at the initial stage of a discharge start. It is therefore considered that grounding the potential of the shield electrode allows suppressing the shield electrode from charging up, thus enabling satisfactory lighting. However, in such a case, an electric discharge is performed from the shield electrode of a ground potential toward the anode of a higher potential, besides an electric discharge from the cathode, and sustained lighting is destabilized.

Therefore, a light source device according to the present invention includes: a sealed vessel filled with gas; a cathode disposed in the sealed vessel; an anode disposed in the sealed vessel; an aperture member having a first opening located on a discharge path between the cathode and the anode; a shield electrode having a second opening located on a discharge path between the cathode and the aperture member; and potential control means for switching over potential of the shield electrode to either of a ground potential and a floating potential.

Thermal electrons generated in the cathode, in principle, pass the inside of the second opening of the shield electrode and the first opening of the aperture member, and are collected by the anode. On this discharge path, in the vicinity of the aperture member, the filled gas is excited, so that light emission is performed.

At the initial stage of a discharge start, a trigger voltage is applied between the cathode and the anode and between the cathode and the aperture member to perform a preliminary discharge. At this time, because the potential of the shield electrode is provided as a ground potential by the potential control means, thermal electrons from the cathode are not accumulated in the shield electrode, and accordingly, the shield electrode does not result in a negative potential, a decline in the amount of thermal electrons leading from the cathode to the aperture member is suppressed, and the lighting performance of the preliminary discharge at the initial stage of discharge is improved. Moreover, after the preliminary discharge, because the potential of the shield electrode is provided as a floating potential by the potential control means, an unwanted discharge from the shield electrode to the anode is suppressed, sustained lighting is stabilized, and the lighting performance is improved.

Such potential control means may be provided within a power supply device outside of the discharge lamp, and even when attached to the discharge lamp itself, it also becomes possible to use an existing power supply, is therefore industrially useful.

That is, a discharge lamp according to the present invention includes: a sealed vessel filled with gas; a cathode disposed in the sealed vessel; an anode disposed in the sealed vessel; an aperture member having a first opening located on a discharge path between the cathode and the anode; a shield electrode having a second opening located on a discharge path between the cathode and the aperture member; and a potential control element for switching over potential of the shield electrode to either of a ground potential and a floating potential.

Because the potential control element serving as potential control means switches over the potential of the shield electrode as described above, the lighting performance at the initial stage of a discharge start and at the sustained lighting can be improved.

Moreover, it is preferable that the potential control element is a bidirectional voltage trigger switch connected between the shield electrode and ground potential. The bidirectional voltage trigger switch is a switch to be connected or disconnected by an input voltage. Preferably, the bidirectional voltage trigger switch is a semiconductor element formed by sequentially laminating a p-type semiconductor, an n-type semiconductor, a p-type semiconductor, an n-type semiconductor, and a p-type semiconductor.

For such a semiconductor element, a conduction state and a disconnection state between both terminals continue according to a voltage between both terminals. When a trigger potential is applied to the aperture member at the initial stage of a discharge start, the potential of the shield electrode located between the aperture member and the cathode rises, and therefore by being triggered with this potential, both terminals of the semiconductor element serving as the bidirectional voltage trigger switch are conducted therebetween.

That is, at the initial stage of a discharge start, the shield electrode is connected to the ground potential via the semiconductor element. Thereafter, when an electrical charge within the shield electrode flows to the ground potential, by being triggered with this potential, both terminals of the semiconductor element are disconnected therebetween. Accordingly, using such an element automatically allows improving the lighting performance of the discharge lamp. As this semiconductor element, bidirectional two-terminal multiple thyristors "SIDAC (Silicon Diode for Alternating Current)" (registered trademark) can be used, and it is also possible to use a TRIAC of the same structure.

Moreover, the potential control element may be a temperature-dependent switch that is connected between the shield electrode and ground potential and disconnected at a rise in temperature. As the temperature-dependent switch, a bimetal switch is known. This switch is disconnected between both terminals thereof with a rise in temperature of the switch at the time of discharge.

That is, at the initial stage of a discharge start, the shield electrode is connected to the ground potential via the selection switch. Thereafter, by heat generation of the switch itself due to an electrical charge within the shield electrode flowing to the ground potential, or radiant heat from gas, the aperture member, or the shield electrode resulting from electric discharge, or heat conducted to the switch from the shield electrode heated by electric discharge, the switch is disconnected. Accordingly, using such a switch automatically allows improving the lighting performance of the discharge lamp.

In addition, the potential control means may have a configuration including: a switch interposed between the shield electrode and ground potential; and detection means for sensing a discharge state after an initial stage of a discharge start, and connecting the switch when the detection means does not sense the discharge state, and when having sensed, disconnecting the switch. In this case, at the initial stage of a discharge start, the shield electrode is connected to the ground potential, and when it then reaches a discharge state, the shield electrode can be provided at a floating potential, and the above-described effects can be provided.

Moreover, a discharge lamp according to the present invention includes: a sealed vessel filled with gas; a cathode disposed in the sealed vessel; an anode disposed in the sealed vessel; an aperture member having a first opening located on a discharge path between the cathode and the anode; a shield electrode having a second opening located on a discharge path between the cathode and the aperture member; and a conductive member electrically connected to the shield electrode, wherein potential of the conductive member is provided as a ground potential at an initial time of a discharge start, and then provided as a floating potential.

That is, as a result of the discharge lamp including this conductive member, the potential of the shield electrode connected to the conductive member can be provided as the ground potential at the initial time of a discharge start, and then provided as a floating potential, and the above-described effects can be provided.

Moreover, a control method for a discharge lamp according to the present invention, in a control method for a discharge lamp including: a sealed vessel filled with gas; a cathode disposed in the sealed vessel; an anode disposed in the sealed vessel; an aperture member having a first opening located on a discharge path between the cathode and the anode; and a shield electrode having a second opening located on a discharge path between the cathode and the aperture member, includes: a preliminary discharge step of providing potential of the shield electrode as ground potential in a period of an initial stage of a discharge start, while applying a trigger voltage between the cathode and the anode and between the cathode and the aperture member; and a main discharge step of applying a main voltage between the cathode and the anode, after the preliminary discharge step, while providing potential of the shield electrode as a floating potential.

In the preliminary discharging step where the trigger voltage is applied, because the shield electrode is grounded, the shield electrode is not charged with a negative potential, a decline in the amount of thermal electrons leading from the cathode to the aperture member is suppressed, and the lighting performance is improved. Moreover, in the main discharging step, because the shield electrode is provided at a floating potential, an electric discharge from the shield electrode to the anode is suppressed, and the lighting performance at the time of sustained discharge is improved.

Effects of the Invention

By the light source device, discharge lamp, and its control method according to the present invention, the lighting performance can be improved.

DESCRIPTION OF REFERENCE NUMERALS

Figure 1:
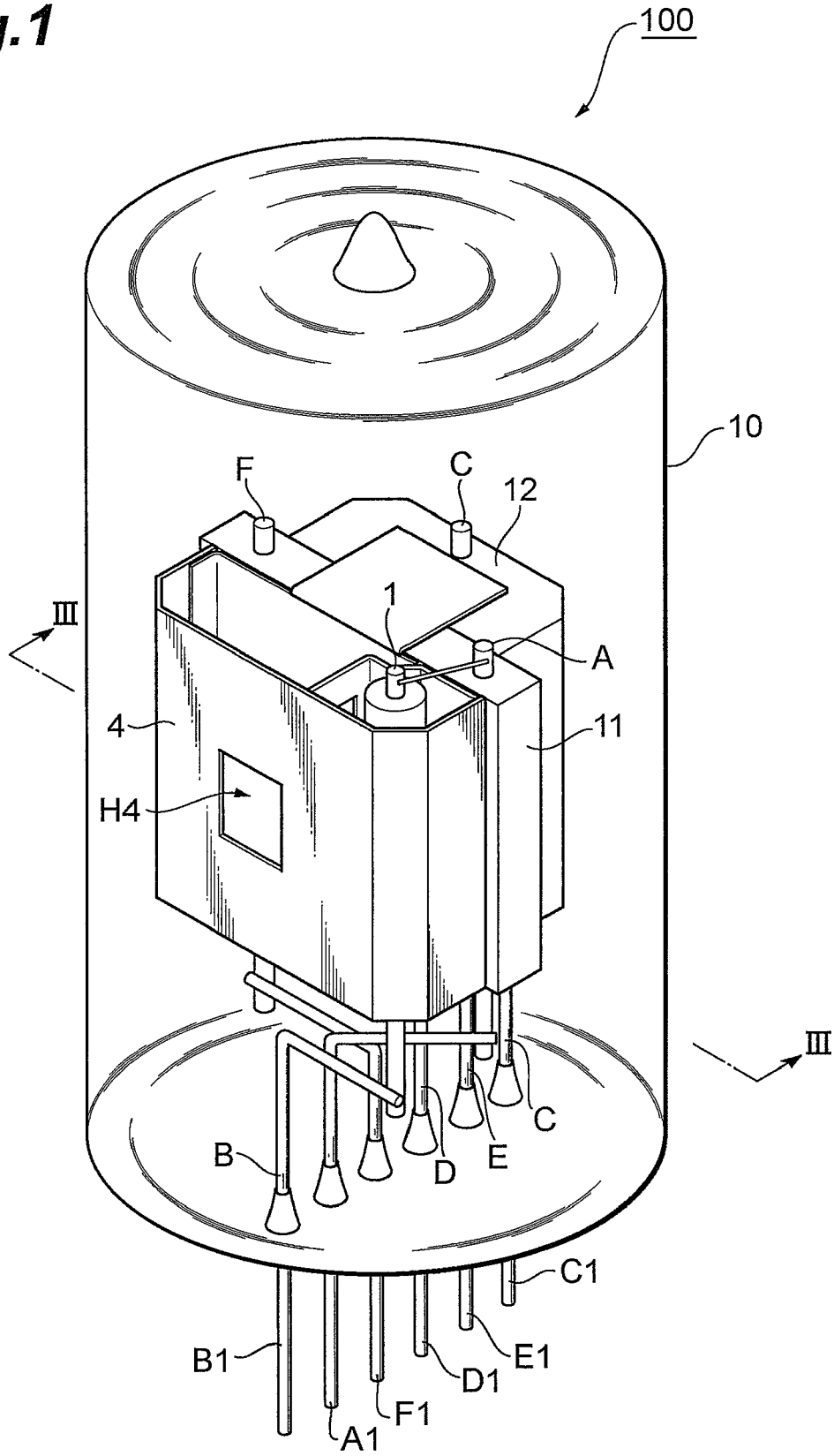
FIG. 1 is a perspective view of a gas discharge tube.

1 Cathode
2 Anode
3 Aperture member
4 Shield electrode
5 Potential control means (potential control element)
5X Bidirectional voltage trigger switch
5E Temperature detecting element
5A Light detecting element
5C Current detecting element
10 Sealed vessel
11 Support portion
12 Base portion
13 Socket
100 Discharge lamp DO Diode
GND Ground potential
H1 Opening
H2 Opening
H3 Opening
H4 Opening
M1 Ammeter
M2 Voltmeter
W Discharge path

BEST MODES FOR CARRYING OUT THE INVENTION

Hereinafter, a light source device, a discharge lamp, and its control method according to an embodiment will be described. The same reference numerals will be used for the same components, and overlapping descriptions will be omitted.

Figure 2:
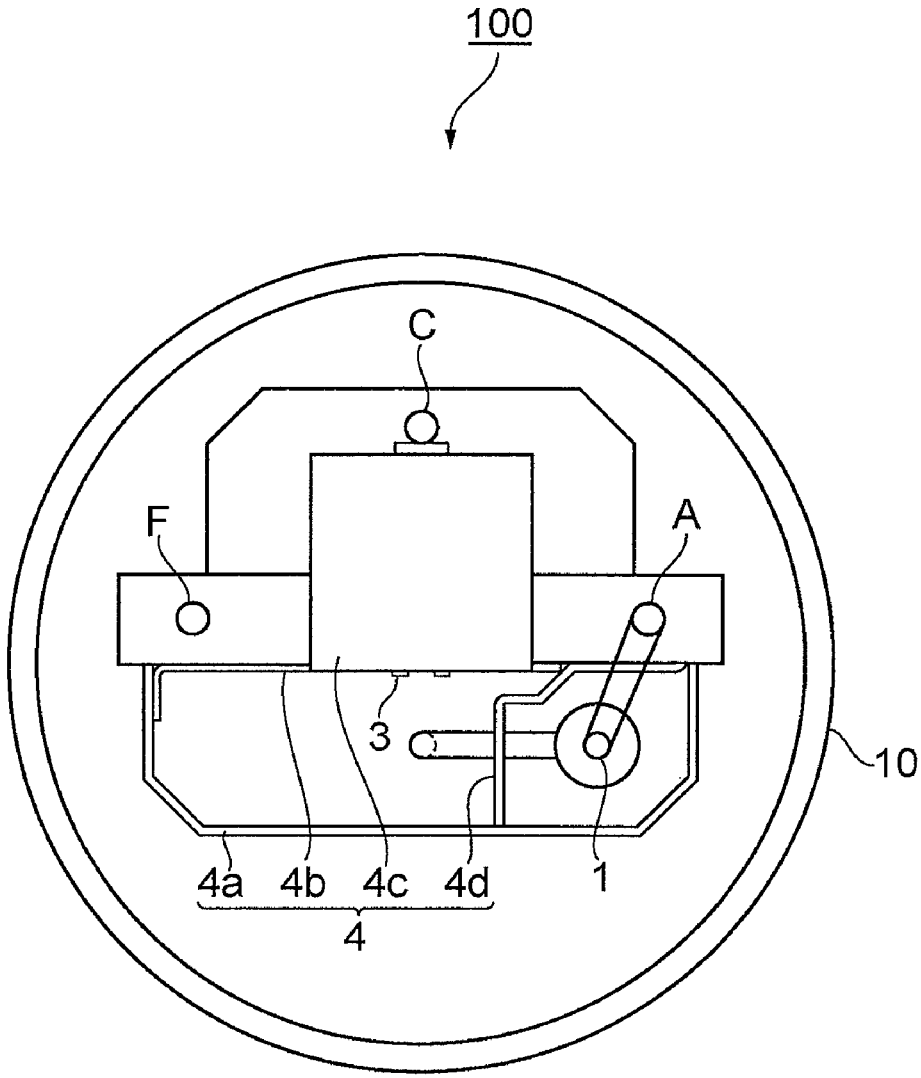
FIG. 2 is a plan view of the gas discharge tube.
Figure 3:
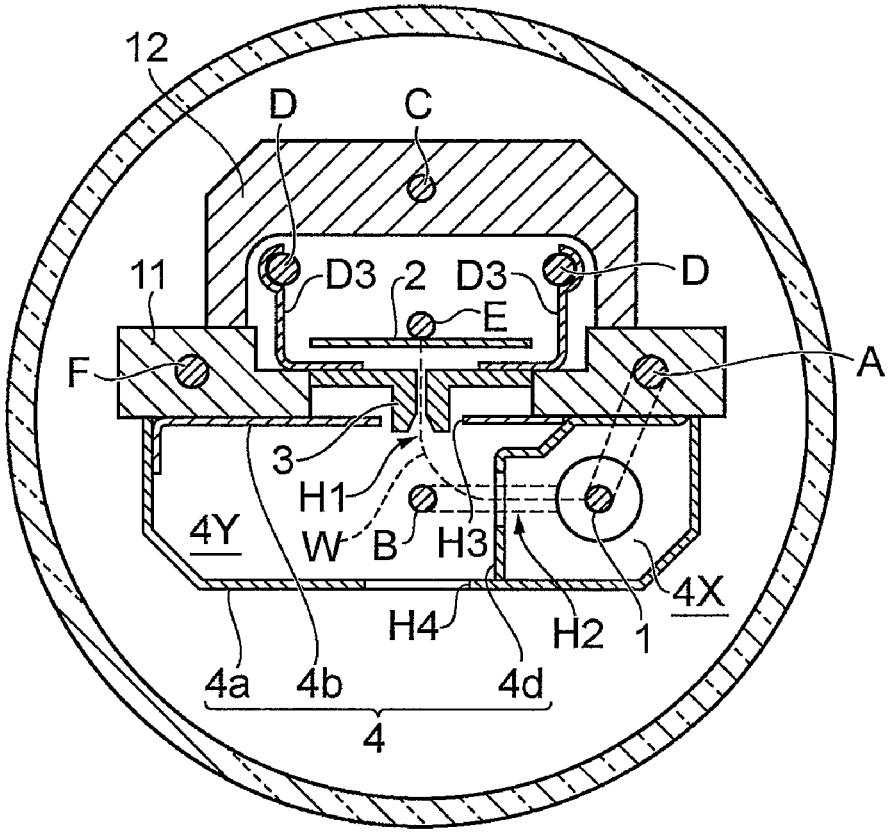
FIG. 3 is a cross-sectional view along arrows III-III of the gas discharge tube.

FIG. 1 is a perspective view of a gas discharge tube, FIG. 2 is a plan view of the gas discharge tube, and FIG. 3 is a cross-sectional view along arrows of the gas discharge tube.

The discharge lamp 100 includes a sealed vessel 10 filled with gas. In the sealed vessel 10, a cathode 1, an anode 2, an aperture member (discharge limiting portion) 3, a shield electrode 4, a support portion 11, a base portion 12, and various pins A, B, C, D, E, and F are disposed. The cathode 1, the anode 2, the aperture member 3, the shield electrode 4, and the various pins A, B, C, D, E, and F are formed of conductors, and the support portion 11 and the base portion 12 are formed of insulators such as ceramics.

The sealed vessel 10 is made of a transparent material, and outputs light generated inside to the outside via a sidewall serving as a window member. A gas discharge tube of a type that outputs light from the side of the sealed vessel 10 is called a side-on type gas discharge tube, and a gas discharge tube of a type that outputs light from the top face of the sealed vessel 10 is called a head-on type gas discharge tube. In this example, a side-on type gas discharge tube is shown. For the material of the window member, borosilicate glass, quartz glass, magnesium fluoride, and the like can be used, while other glass materials can also be applied to the window member.

The cathode 1 is formed of a filament wound in a coil shape, and when current is supplied between both ends of the filament via support pins A and B, the filament serving as the cathode 1 is heated, and thermal electrons are emitted from the cathode 1.

As the gas to be filled in the sealed vessel 10, a rare gas, a mercury gas, or a deuterium gas has been known. The discharge lamp of this example is a deuterium lamp. Deuterium lamps generate continuous spectra in ultraviolet regions by discharge of a deuterium gas, and have been used for analytical instruments and the like.

The anode 2 is supported by the support pin E, and collects thermal electrons generated in the cathode 1.

The aperture member 3 is a member having a first opening H1 that performs narrowing of an electric field, and is electrically connected to the support pin D via a connection member D3. An opening end face around the first opening H1 of the aperture member 3 projects toward the shield electrode 4, and this projecting part slightly projects from an opening H3 of the shield electrode.

The shield electrode 4 is a box-shaped member with two chambers 4X and 4Y partitioned by a partition plate 4*d*, the cathode 1 is disposed in the first chamber 4X, and the first chamber 4X and the second chamber 4Y communicate with each other via a rectangular second opening H2 provided in the partition plate 4*d*. The first chamber 4X is defined by a front face plate 4*a* in which a light exit opening H4 is provided and the partition plate 4*d*, and one end of the partition plate 4*d* is fixed to the support portion 11. The second chamber 4Y is defined by a fixing plate 4*b* having the opening H3 and the front face plate 4*a*.

The support portion 11 is fixed to the base portion 12, and the anode 2 and the support pins C and D are disposed in a space therebetween. The support portion 11 has a through-hole at the center, and the aperture member 3 is disposed in the through-hole. A front face of the connection member D3 fixed to a rear face of the aperture member 3 is in contact with a rear face of the support portion 11, and thus positioning of the aperture member 3 is performed. The support pin A and the support pin F penetrate through widthwise both end portions of the support portion 11 parallel to a tube axis, respectively. At the center of the base portion 12, the support pin C penetrates therethrough parallel to the tube axis, and the support pin C is electrically connected to the shield electrode 4. In detail, the shield electrode 4 includes a top face plate 4*c* extending rearward from an upper end portion of the rear face plate 4*b*, and the top face plate 4*c* is fixed to the support pin C, whereby the shield electrode 4 and the support pin C are electrically connected to each other.

The first opening H1 of the aperture member 3 is located on a discharge path W between the cathode 1 and the anode 2, and the second opening H2 of the shield electrode 4 is located on a discharge path W between the cathode 1 and the aperture member 3. That is, thermal electrons generated in the cathode 1 lead to the anode 2 via the second opening H2 and the first opening H1.

In addition, the above-described support pins A, B, C, D, E, and F are respectively fixed to lead pins (lead terminals) A1, B1, C1, D1, E1, and F1 extending to the outside of the sealed vessel 10, and electrically connected thereto.

Figure 4:
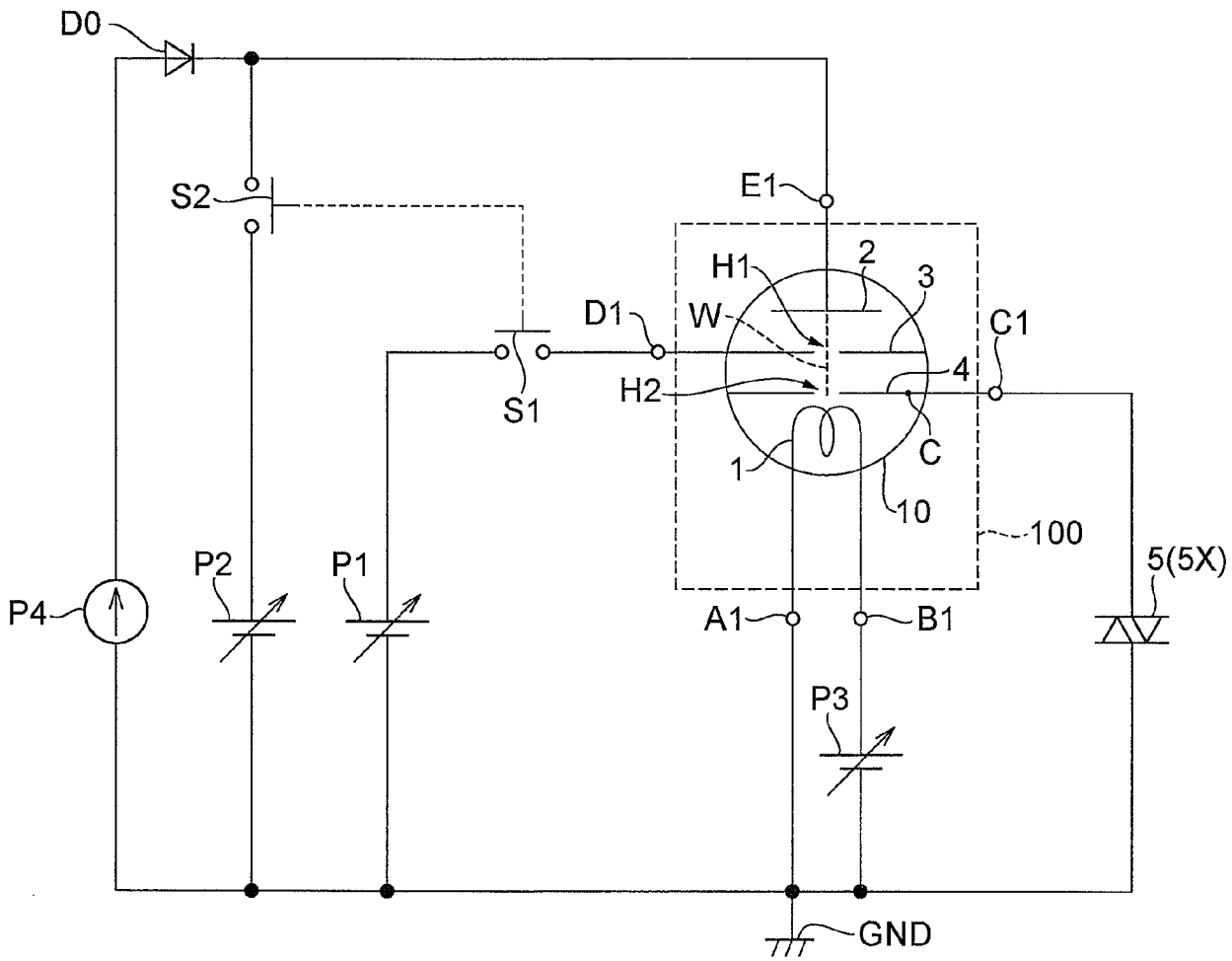
FIG. 4 is a circuit diagram of a light source device using a bidirectional voltage trigger switch.

FIG. 4 is a circuit diagram of a light source device using a bidirectional voltage trigger switch 5X.

The terminal A1 at one end of the cathode 1 of the discharge lamp 100 is connected to a ground potential GND, and the terminal B1 at the other end thereof is connected to a high potential side of a heater power supply P3.

The terminal E1 of the anode 2 is connected to a high potential side of a main power supply P4 via a diode DO. Moreover, the terminal E1 of the anode 2 is connected to a high potential side of a trigger power supply P2 via a switch S2.

The terminal D1 of the aperture member 3 is connected to a high potential side of a trigger power supply P1 via a switch S1. A low potential side of the trigger power supply P1, P2 is connected to the ground potential GND.

Between the terminal C1 of the shield electrode 4 and the ground potential GND, a potential control element 5 (bidirectional voltage trigger switch 5X) serving as potential control means is electrically connected.

The potential control element 5 switches over the potential of the shield electrode 4 to either of the ground potential GND and a floating potential. The discharge lamp 100 is lit through the following steps.

(1) Thermal Electron Generating Step

The cathode 1 is heated for approximately 20 seconds by supplying electricity from the heater power supply P3 to the cathode 1 so as to emit thermal electrons from the cathode 1.

(2) Primary Electric Field Forming Step

Voltage is applied between the cathode 1 and the anode 2 by the main power supply P4 so as to generate, between the cathode 1 and the anode 2, a primary electric field where thermal electrons receive a force in a direction of the anode 2. This primary electric field is formed along the discharge path W.

(3) Preliminary Discharging Step

At an initial stage of a discharge start, a preliminary discharge is performed. That is, by connecting the switch S1, a trigger voltage is applied between the cathode 1 and the aperture member 3 from the trigger power supply P1. This produces a preliminary discharge between the cathode 1 and the aperture member 3, so that charged particles are generated in the vicinity of the opening H1 of the aperture member 3. By simultaneously connecting the switch S2 in conjunction with a connection of the switch S1, a trigger voltage is applied between the cathode 1 and the anode 2 from the trigger power supply P2. The connection timings of the switch S1 and the switch S2 may be either coincident with each other, or shifted from each other by a slight time difference. Moreover, the trigger potential to be applied to the anode 2 is higher than that to be applied to the aperture member 3. For this, the charged particles generated in the vicinity of the opening H1 of the aperture member 3 pass through the opening H1 and lead to the anode 2, and thus a preliminary discharge is performed.

Here, as a result of the potential control element (means) 5 becoming conductive in the preliminary discharge period, the potential of the shield electrode 4 is provided as the ground potential GND. That is, according to this control method, in the period of the initial stage of a discharge start, a trigger voltage is applied between the cathode 1 and the anode 2 and between the cathode 1 and the aperture member 3, with the potential of the shield electrode 4 being provided as the ground potential GND. In the preliminary discharging step where the trigger voltage is applied, because the shield electrode 4 is grounded, thermal electrons from the cathode 1 are not accumulated in the shield electrode 4, and accordingly, the shield electrode 4 is not charged with a negative potential, a decline in the amount of thermal electrons leading from the cathode 1 to the aperture member 3 is suppressed, and the lighting performance is improved. That is, this device allows reliably generating charged particles in the vicinity of the opening H1 of the aperture member 3 so as to reliably form a main discharge.

(4) Main Discharging Step

A main discharge is performed subsequent to the preliminary discharge. After the main discharge is formed, the potential of the shield electrode 4 is provided as a floating potential. That is, by disconnecting the potential control element 5, the shield electrode 4 is separated from the ground potential GND. In the main discharging step, because the shield electrode 4 is provided at a floating potential by the potential control element (means) 5, an unwanted discharge from the shield electrode 4 to the anode 2 is suppressed, a sustained discharge is stabilized, and the lighting performance is improved.

The thermal electrons generated in the cathode 1, in principle, pass the inside of the second opening H2 of the shield electrode 4 and the first opening H1 of the aperture member 3, and are collected by the anode 2. On this discharge path W, in the vicinity of the aperture member 3, the filled gas is excited, so that light emission is performed.

The above-described potential control element (means) 5 may be provided within a power supply device outside of the discharge lamp 100, and even when attached to the discharge lamp 100 itself, it also becomes possible to use an existing power supply device, is therefore industrially useful.

Figure 16:
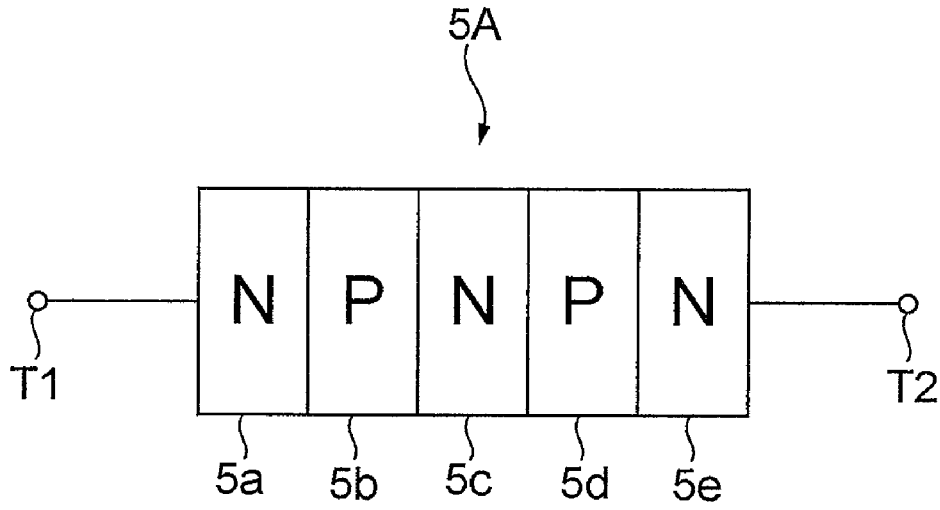
FIG. 16 is a view showing a bidirectional voltage trigger switch.

The potential control element 5 of this example is a bidirectional voltage trigger switch 5X connected between the shield electrode 4 and the ground potential GND. The bidirectional voltage trigger switch 5X is a switch to be connected or disconnected by an input voltage. Preferably, the bidirectional voltage trigger switch 5X is a semiconductor element as shown in FIG. 16.

For such a semiconductor element, a conduction state and a disconnection state between both terminals T1 and T2 (see FIG. 16) continue according to a voltage between both terminals.

When a trigger potential is applied to the aperture member 3 at the initial stage of a discharge start described above, the potential of the shield electrode 4 located between the aperture member 3 and the cathode 1 rises, and therefore by being triggered with this potential, both terminals of the semiconductor element serving as the bidirectional voltage trigger switch 5X are conducted therebetween.

That is, at the initial stage of a discharge start, the shield electrode 4 is connected to the ground potential GND via the semiconductor element serving as the bidirectional voltage trigger switch 5X. Thereafter, when an electrical charge within the shield electrode 4 flows to the ground potential GND, by being triggered with this potential, both terminals of the bidirectional voltage trigger switch 5X are disconnected therebetween. Accordingly, using such an element automatically allows improving the lighting performance of the discharge lamp 100. As this semiconductor element, bidirectional two-terminal multiple thyristors "SIDAC" (registered trademark) can be used, and it is also possible to use a TRIAC of the same structure.

Moreover, the discharge lamp 100 of this example, when focusing on the support pin C, includes the support pin (conductive member) C electrically connected to the shield electrode 4, and the potential of the support pin C is provided as the ground potential GND at the initial time of a discharge start, and then provided as a floating potential. That is, as a result of the discharge lamp 100 including this support pin C, the potential of the shield electrode 4 connected to the support pin C can be provided as the ground potential GND at the initial time of a discharge start, and then provided as a floating potential, and the above-described effects can be provided.

Figure 5:
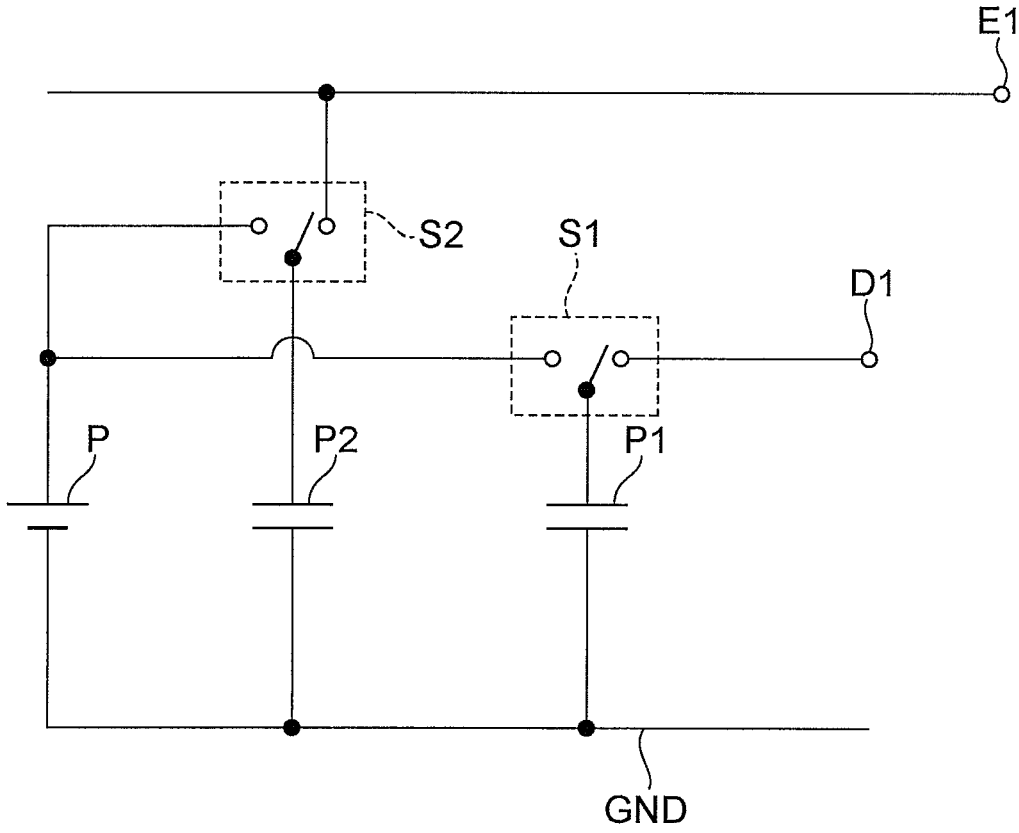
FIG. 5 is a circuit diagram of a trigger power supply.

FIG. 5 is a circuit diagram of a trigger power supply.

The trigger power supply P1, P2 shown in FIG. 4 can be constructed by, for example, the circuit shown in FIG. 5.

The trigger power supply P1 is a capacitor that is connected to a main power supply P for a trigger power supply via a changeover switch S1, and if the changeover switch S1 is connected to the side of the main power supply P for a trigger power supply, the capacitor is charged, and if connected to the side of the terminal D1, by using this capacitor as a trigger power supply P1, a trigger voltage is applied between the terminal D1 and the ground potential GND.

The trigger power supply P2 is a capacitor that is connected to the main power supply P for a trigger power supply via a changeover switch S2, and if the changeover switch S2 is connected to the side of the main power supply P for a trigger power supply, the capacitor is charged, and if connected to the side of the terminal E1, by using this capacitor as a trigger power supply P2, a trigger voltage is applied between the terminal E1 and the ground potential GND.

Figure 6:
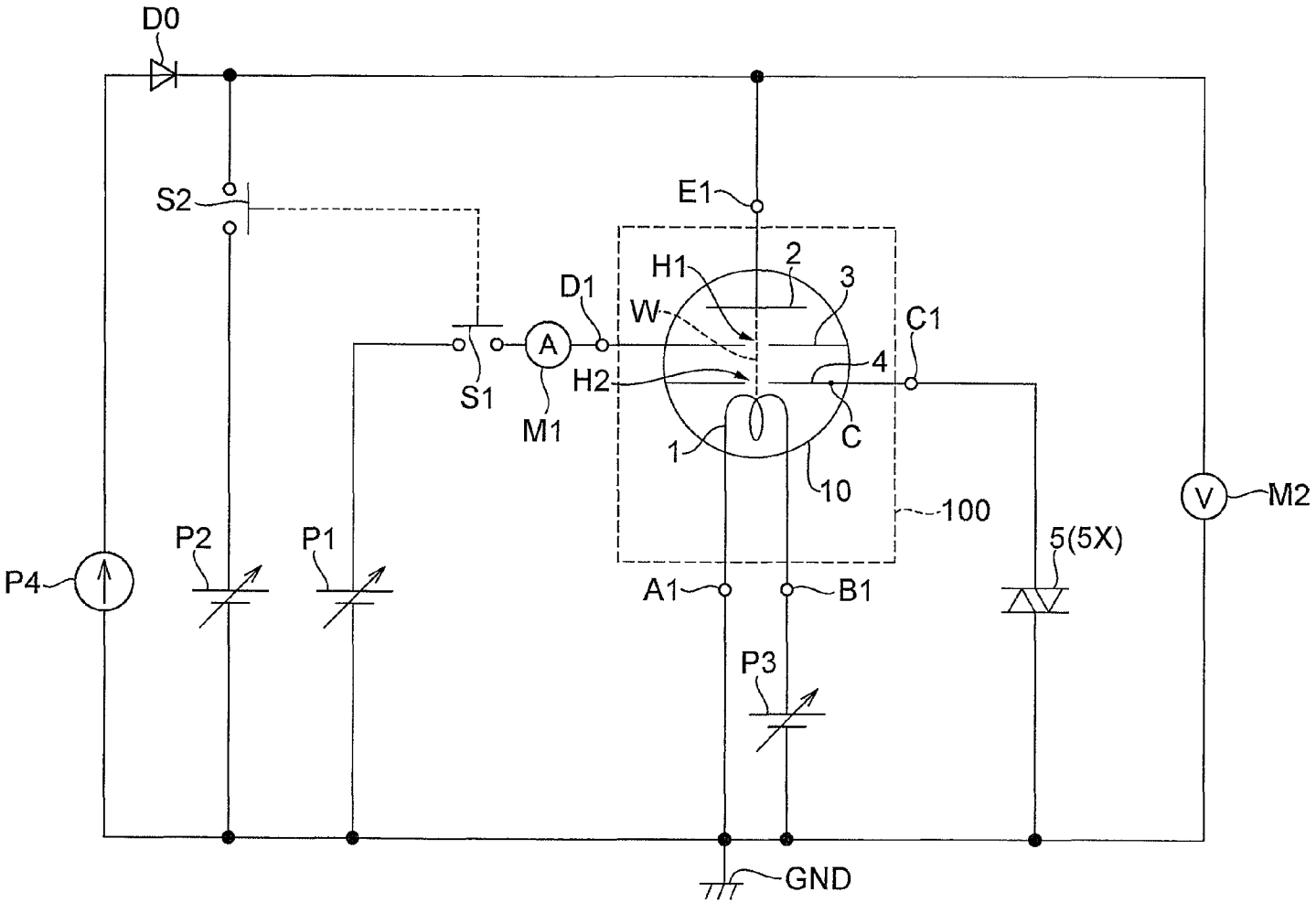
FIG. 6 is a circuit diagram of a light source device used for experimentation.

FIG. 6 is a circuit diagram of a light source device used for experimentation.

For this light source device, an ammeter M1 is inserted between the terminal D1 and the switch S1, and a voltmeter M2 is inserted between the terminal E1 and the ground potential GND in the light source device of FIG. 4. Upon application of a trigger voltage, a current flowing through the aperture member 3 was measured by the ammeter M1, and a voltage between the cathode 1 and the anode 2 was measured by the voltmeter M2.

The light source device shown in FIG. 6 is referred to as an example, while a light source device for which the potential control element 5 has been excluded from the light source device shown in FIG. 6 is referred to as a comparative example.

Figure 7:
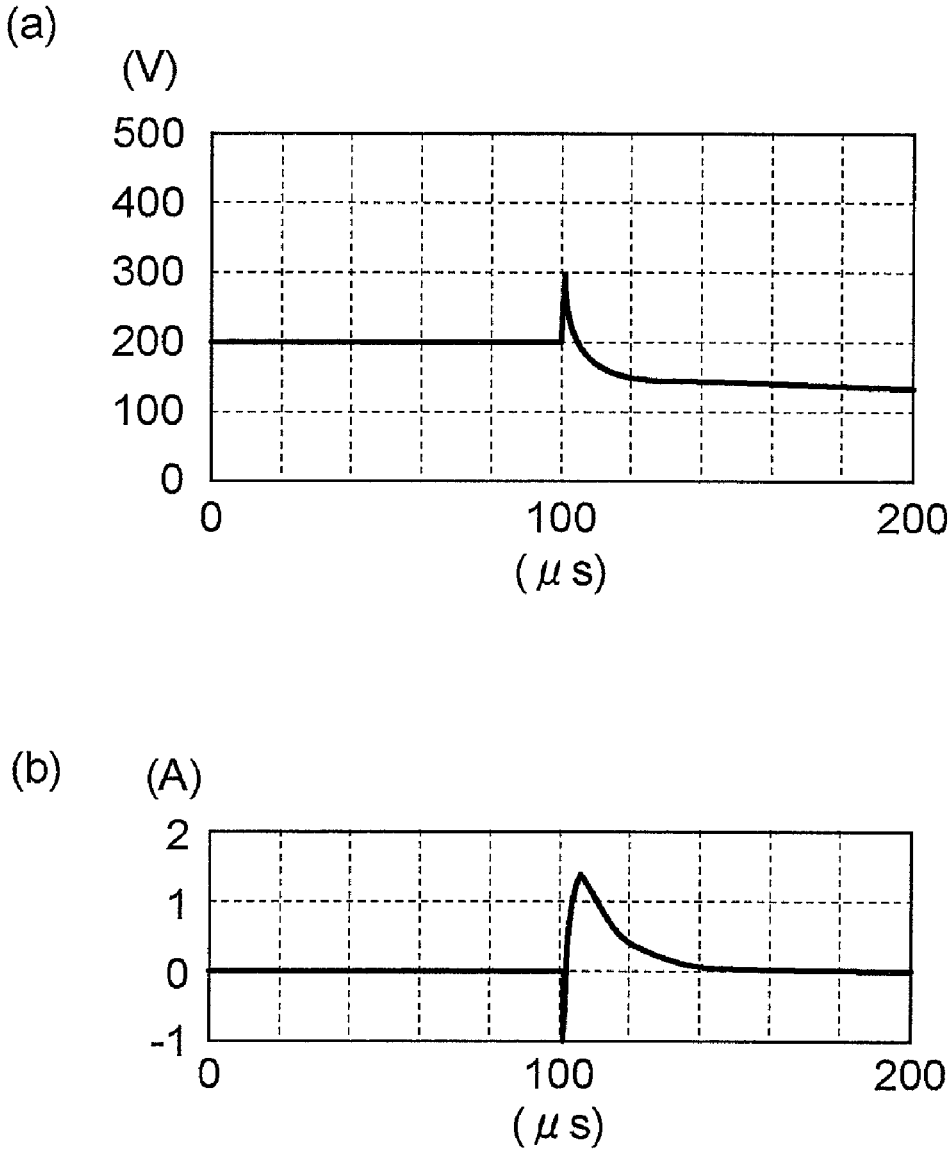
FIG. 7 shows a time waveform (a) of an anode voltage, and a time waveform (b) of a current flowing through an aperture member, according to an example.
Figure 8:
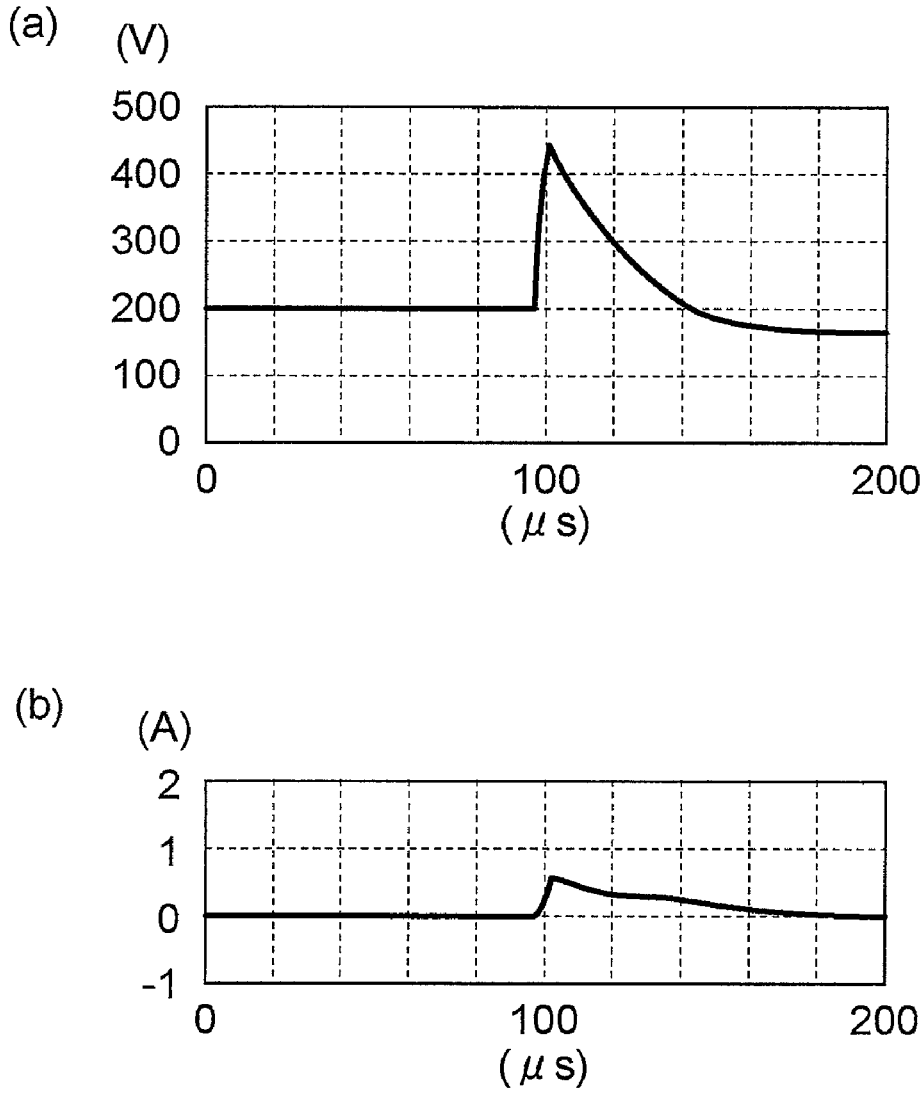
FIG. 8 shows a time waveform (a) of an anode voltage, and a time waveform (b) of a current flowing through an aperture member, according to a comparative example.

FIG. 7 shows a time waveform (a) of an anode voltage, and a time waveform (b) of a current flowing through an aperture member, according to the example. In addition, FIG. 8 shows a time waveform (a) of an anode voltage, and a time waveform (b) of a current flowing through an aperture member, according to the comparative example.

In the light source device according to the example, because the shield electrode 4 is not charged, a large amount of current flows to the aperture member 3, and a satisfactory preliminary discharge is performed. On the other hand, in the light source device according to the comparative example, because the shield electrode 4 has been charged, only a small amount of current flows to the aperture member 3, and it can be understood that a satisfactory preliminary discharge is not performed.

Figure 9:
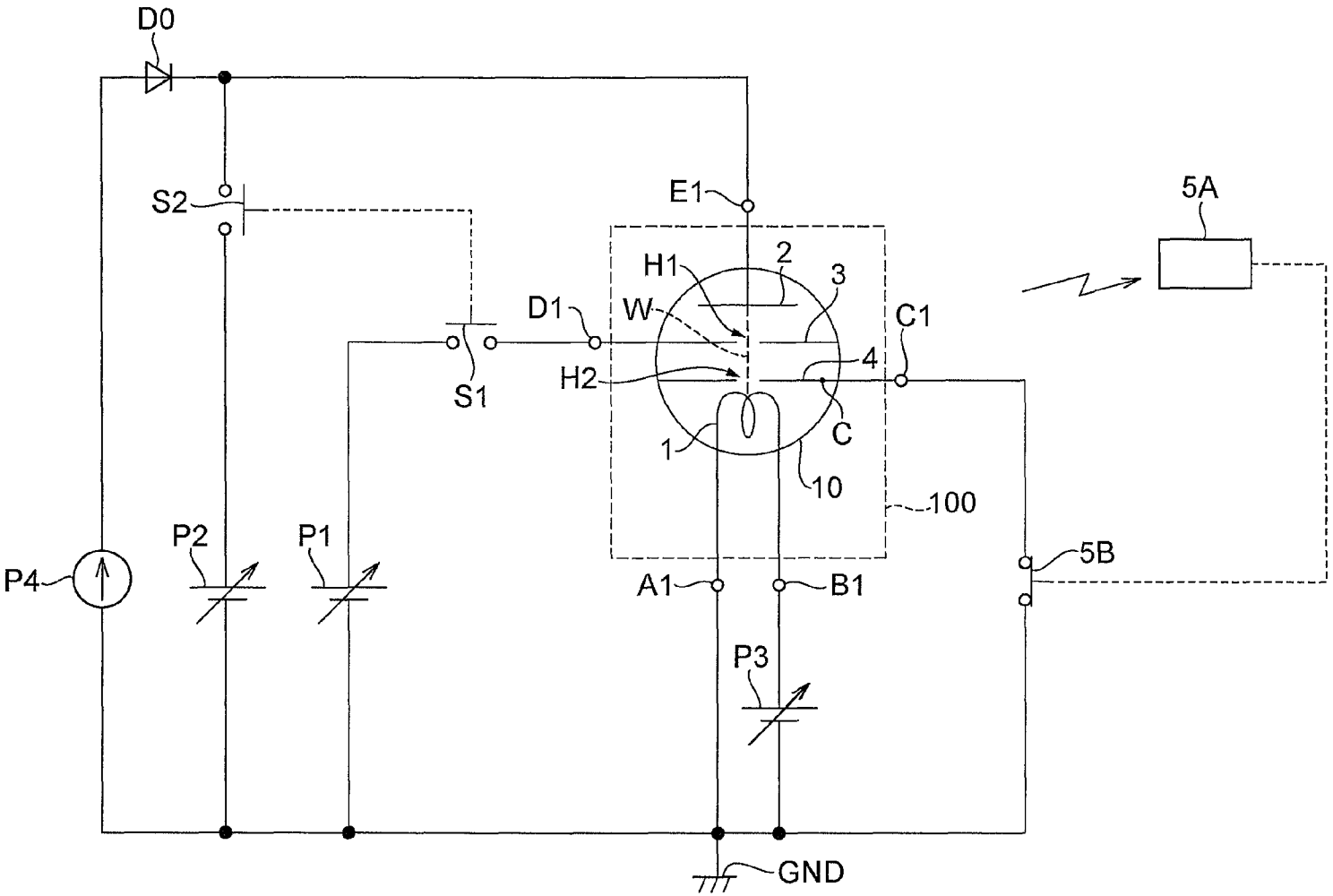
FIG. 9 is a circuit diagram of a light source device using a light detecting element and a switch.

FIG. 9 is a circuit diagram of a light source device using a light detecting element and a switch.

As the above-described potential control means 5, it is also possible to use a light detecting element 5A and a switch 5B.

That is, the potential control means includes the switch 5B interposed between the shield electrode 4 and the ground potential GND and the light detecting element (detection means) 5A for sensing a discharge state after the initial stage of a discharge start, and when the light detecting element 5A does not sense a discharge state, the switch 5B is connected, and when having sensed, the switch 5B is disconnected. In this case, at the initial stage of a discharge start, the shield electrode 4 is connected to the ground potential GND, and when it then reaches a discharge state, the shield electrode 4 can be provided at a floating potential, and the above-described effects can be provided.

If the light detecting element 5A is provided as a photodiode, output of the photodiode increases when a main discharge is started, so that a discharge state after the initial stage of a discharge start can be sensed. Accordingly, it suffices to connect the photodiode and the switch 5B so that the switch 5B is disconnected by the increase in output. If the switch 5B is provided as a field-effect transistor or a bipolar transistor, an output of the photodiode is input to a gate or a base thereof. When, for example, a current of the photodiode is applied to a resistor and converted to a voltage, an output voltage increases with an increase in the amount of light (amount of discharge) from the discharge lamp, and therefore inputting this voltage to a normally-on p-channel FET allows achieving the above-described operation.

Figure 10:
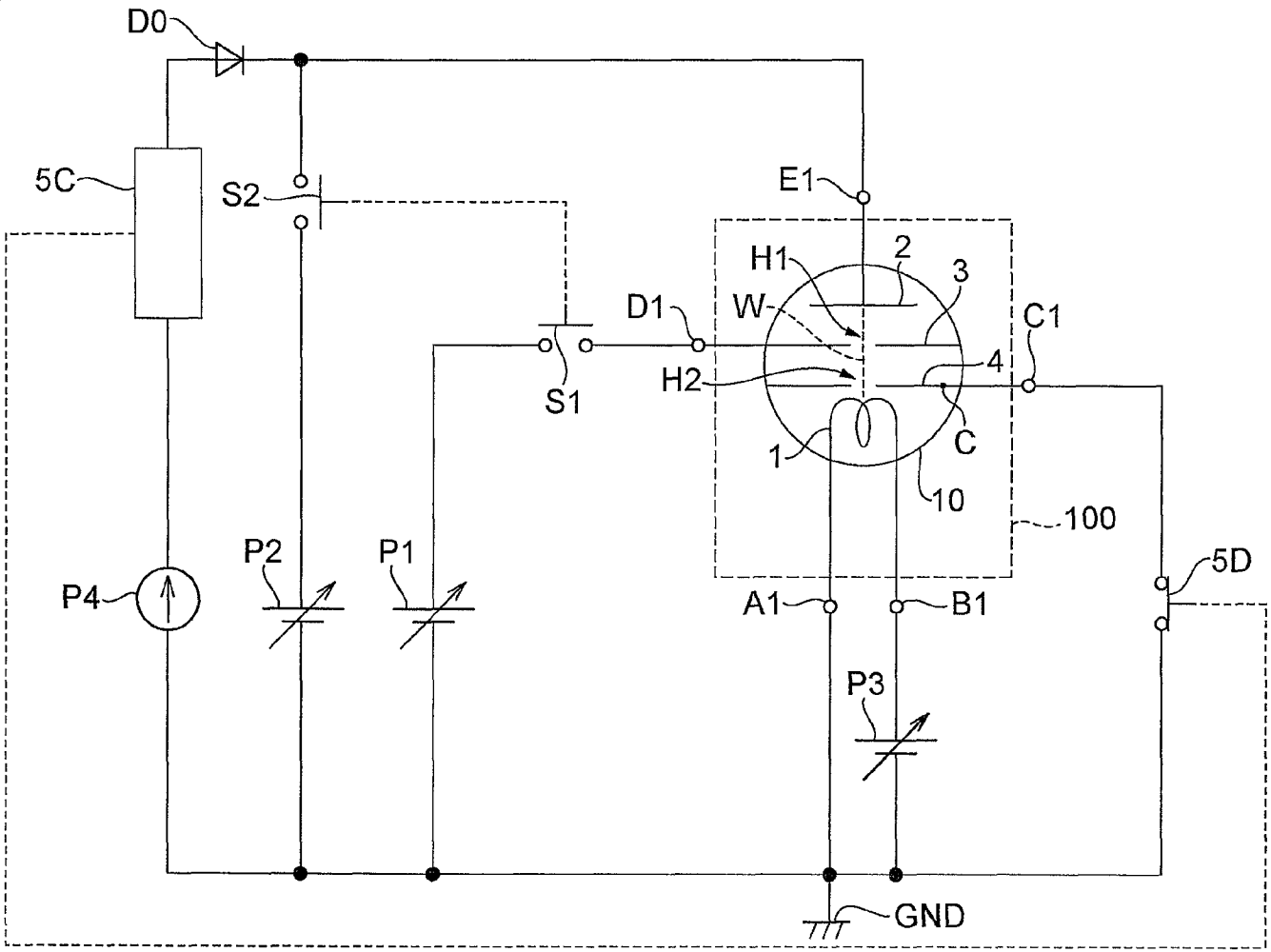
FIG. 10 is a circuit diagram of a light source device using a current detecting element and a switch.

FIG. 10 is a circuit diagram of a light source device using a current detecting element and a switch.

As the above-described potential control means 5, it is also possible to use a current detecting element 5C and a switch 5D.

That is, the potential control means includes the switch 5D interposed between the shield electrode 4 and the ground potential GND and the current detecting element (detection means) 5C for sensing a discharge state after the initial stage of a discharge start, and when the current detecting element 5C does not sense a discharge state, the switch 5D is connected, and when having sensed, the switch 5D is disconnected. In this case as well, at the initial stage of a discharge start, the shield electrode 4 is connected to the ground potential GND, and when it then reaches a discharge state, the shield electrode 4 can be provided at a floating potential, and the above-described effects can be provided.

If the current detecting element 5C is provided as a resistor connected in series to the main power supply P4, voltage between both terminals of the resistor increases when a main discharge is started, so that a discharge state after the initial stage of a discharge start can be sensed. Accordingly, it suffices to connect the resistor and the switch 5D so that the switch 5D is disconnected by the increase in output. If the switch 5B is provided as a field-effect transistor or a bipolar transistor, a voltage between both terminals of the resistor may be input to the transistor according to the same method as the above.

Figure 11:
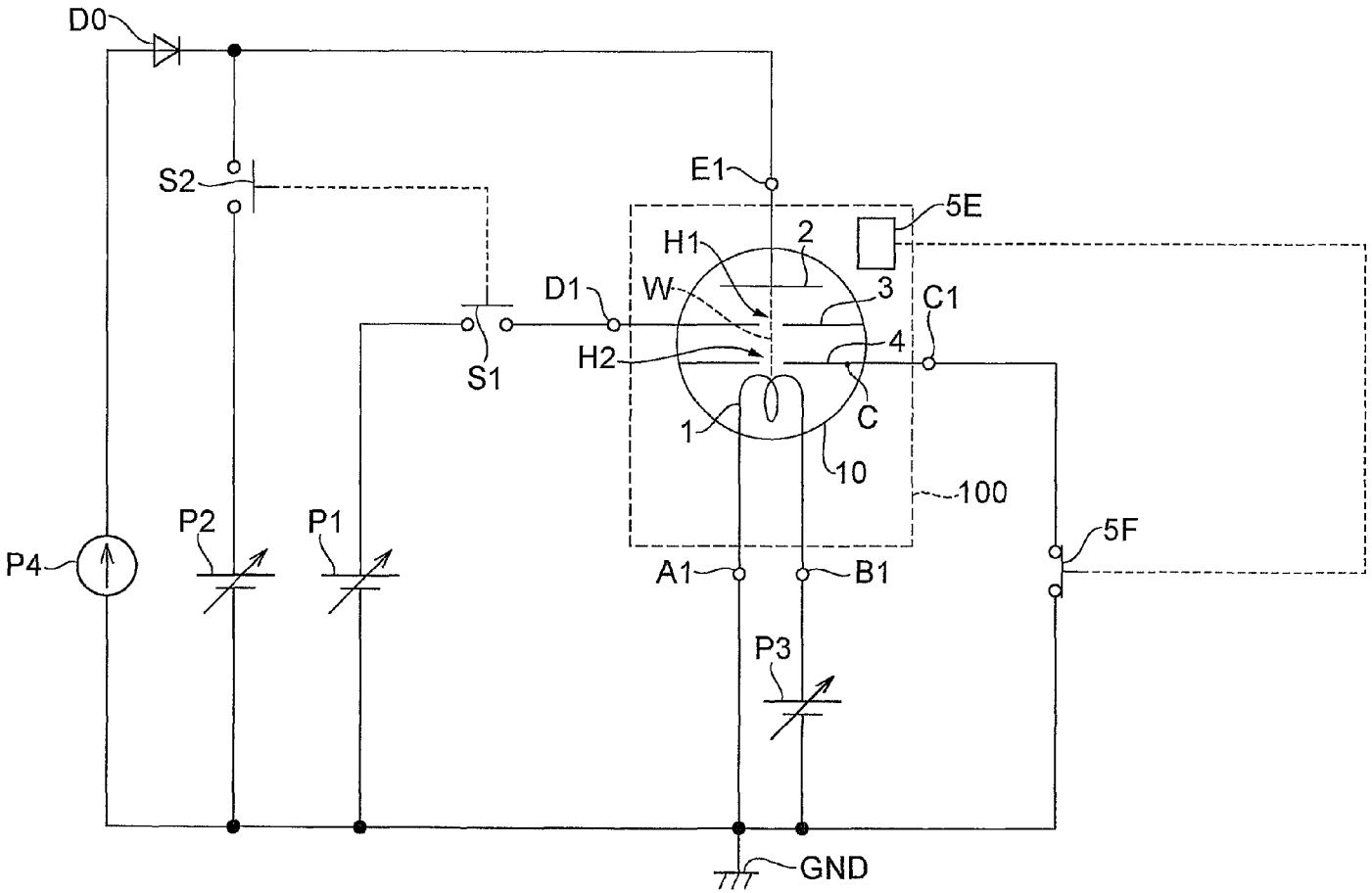
FIG. 11 is a circuit diagram of a light source device using a temperature detecting element and a switch.

FIG. 11 is a circuit diagram of a light source device using a temperature detecting element and a switch.

As the above-described potential control means 5, it is also possible to use a temperature detecting element 5E and a switch 5F.

That is, the potential control means includes the switch 5F interposed between the shield electrode 4 and the ground potential GND and temperature detecting element (detection means) 5E for sensing a discharge state after the initial stage of a discharge start, and when the temperature detecting element 5E does not sense a discharge state, the switch 5F is connected, and when having sensed, the switch 5F is disconnected. In this case as well, at the initial stage of a discharge start, the shield electrode 4 is connected to the ground potential GND, and when it then reaches a discharge state, the shield electrode 4 can be provided at a floating potential, and the above-described effects can be provided.

If the temperature detecting element 5E is provided as a temperature sensor disposed at a position where radiant heat from the discharge lamp 100 can be detected, voltage between both terminals of the temperature sensor increases when a main discharge is started, so that a discharge state after the initial stage of a discharge start can be sensed. Accordingly, it suffices to connect the temperature sensor and the switch 5F so that the switch 5F is disconnected by the increase in output. If the switch 5F is provided as a field-effect transistor or a bipolar transistor, an output voltage of the temperature sensor may be input to the transistor according to the same method as that of the above voltage between both terminals of the resistor.

Figure 12:
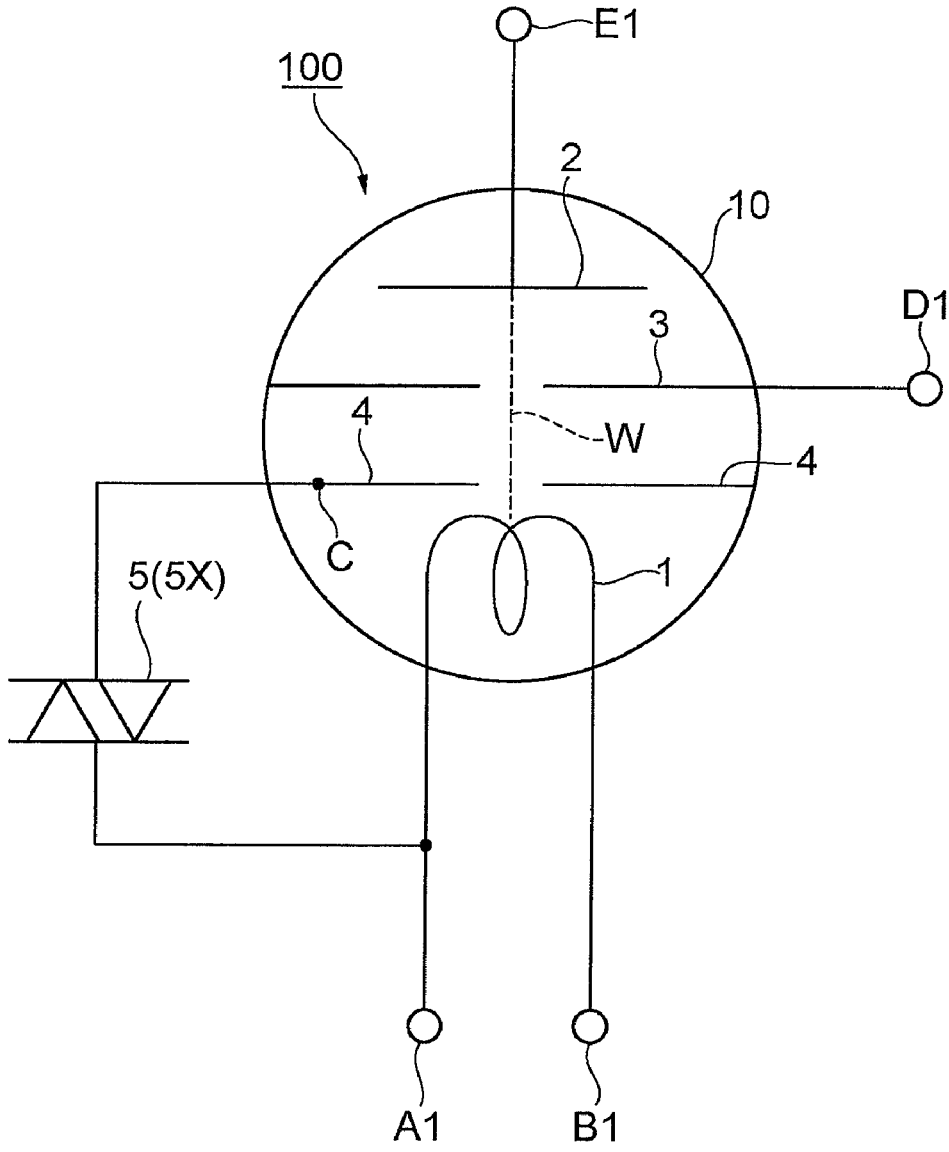
FIG. 12 is a circuit diagram of a discharge lamp using a bidirectional voltage trigger switch.

FIG. 12 is a circuit diagram of a discharge lamp using a bidirectional voltage trigger switch.

As the potential control element 5 (5X), the shield electrode 4 and the ground potential-side terminal A1 of the cathode 1 are electrically connected. As described above, at the initial stage after starting preliminary discharge, a potential between both terminals of the bidirectional voltage trigger switch 5X increases, the bidirectional voltage trigger switch 5X is conducted, and the shield electrode 4 is connected to the ground potential. This prevents charging of the shield electrodes 4, allowing performance of a sufficient preliminary discharge.

Moreover, when an electrical charge of the shield electrode 4 is discharged, as described above, the bidirectional voltage trigger switch 5X is disconnected, and the shield electrode 4 reaches a floating potential. This allows stably sustaining a main discharge.

Figure 13:
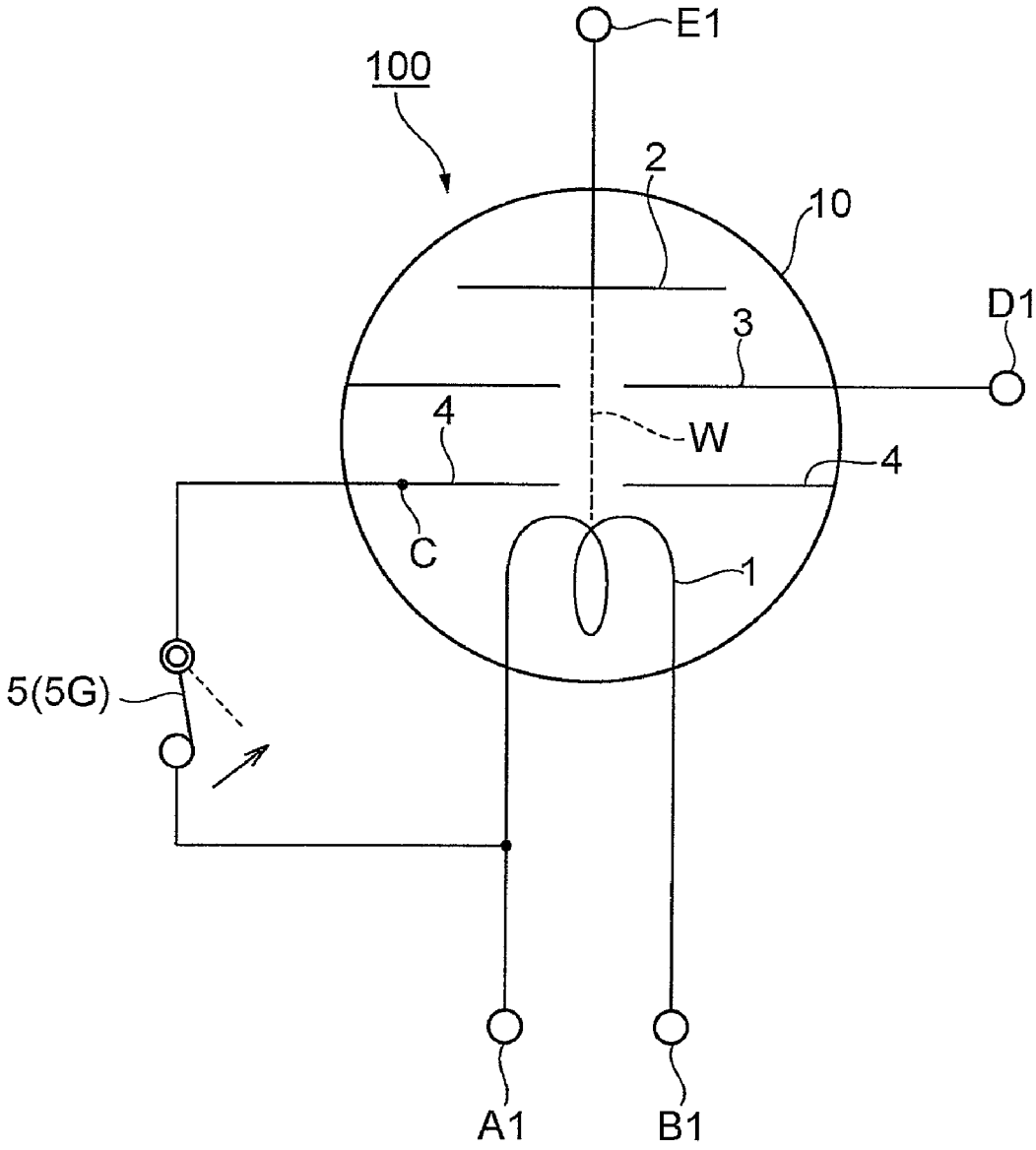
FIG. 13 is a circuit diagram of a discharge lamp using a temperature-dependent switch.

FIG. 13 is a circuit diagram of a discharge lamp using a temperature-dependent switch.

That is, the potential control element 5 is a temperature-dependent switch 5G that is connected between the shield electrode 4 and the ground potential (the ground potential-side terminal A1 of the cathode 1), and disconnected at a rise in temperature. As the temperature-dependent switch 5G, a bimetal switch is known. This switch 5G is disconnected between both terminals thereof with a rise in temperature of the switch 5G at the time of discharge.

That is, at the initial stage of a discharge start, the shield electrode 4 is connected to the ground potential via the switch 5G. Thereafter, by heat generation of the switch 5G itself due to an electrical charge within the shield electrode 4 flowing to the ground potential, or radiant heat from gas, the aperture member 3, or the shield electrode 4 resulting from electric discharge, or heat conducted to the switch 5G from the shield electrode 4 heated by electric discharge, the switch 5G is disconnected. Accordingly, using such a switch 5G automatically allows improving the lighting performance of the discharge lamp 100.

Figure 14:
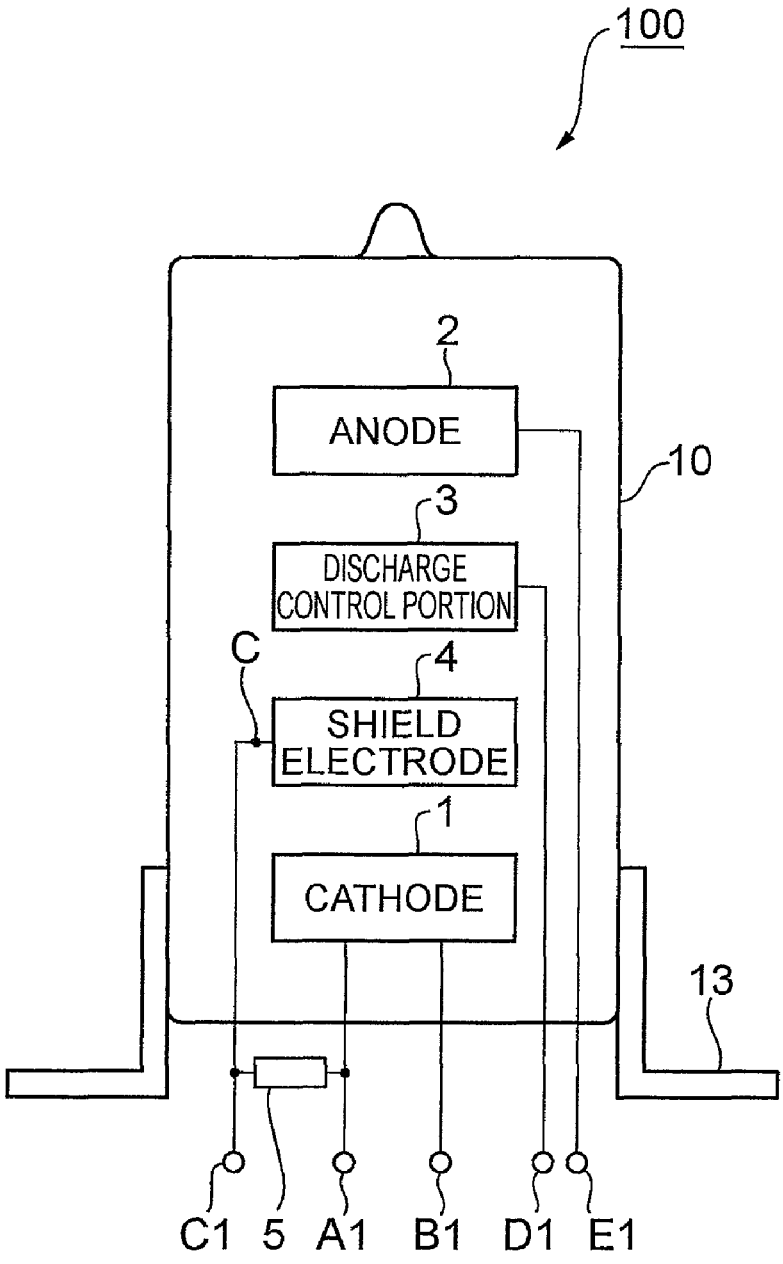
FIG. 14 is a schematic view of a discharge lamp including a potential control element outside of a sealed vessel.

FIG. 14 is a schematic view of a discharge lamp including a potential control element outside of a sealed vessel.

The above-described potential control element 5 can be disposed outside of the sealed vessel 10. The discharge lamp 100 includes a socket 13 fixed around a side tube of the sealed vessel 10, and in an interior space of the socket 13, the above-described potential control element 5 is disposed. The potential control element 5 is electrically connected between the terminal C1 connected to the shield electrode 4 and the cathode ground potential-side terminal A1, and as the potential control terminal 5, the bidirectional voltage trigger switch 5X or the temperature-dependent switch 5G can be adopted.

Figure 15:
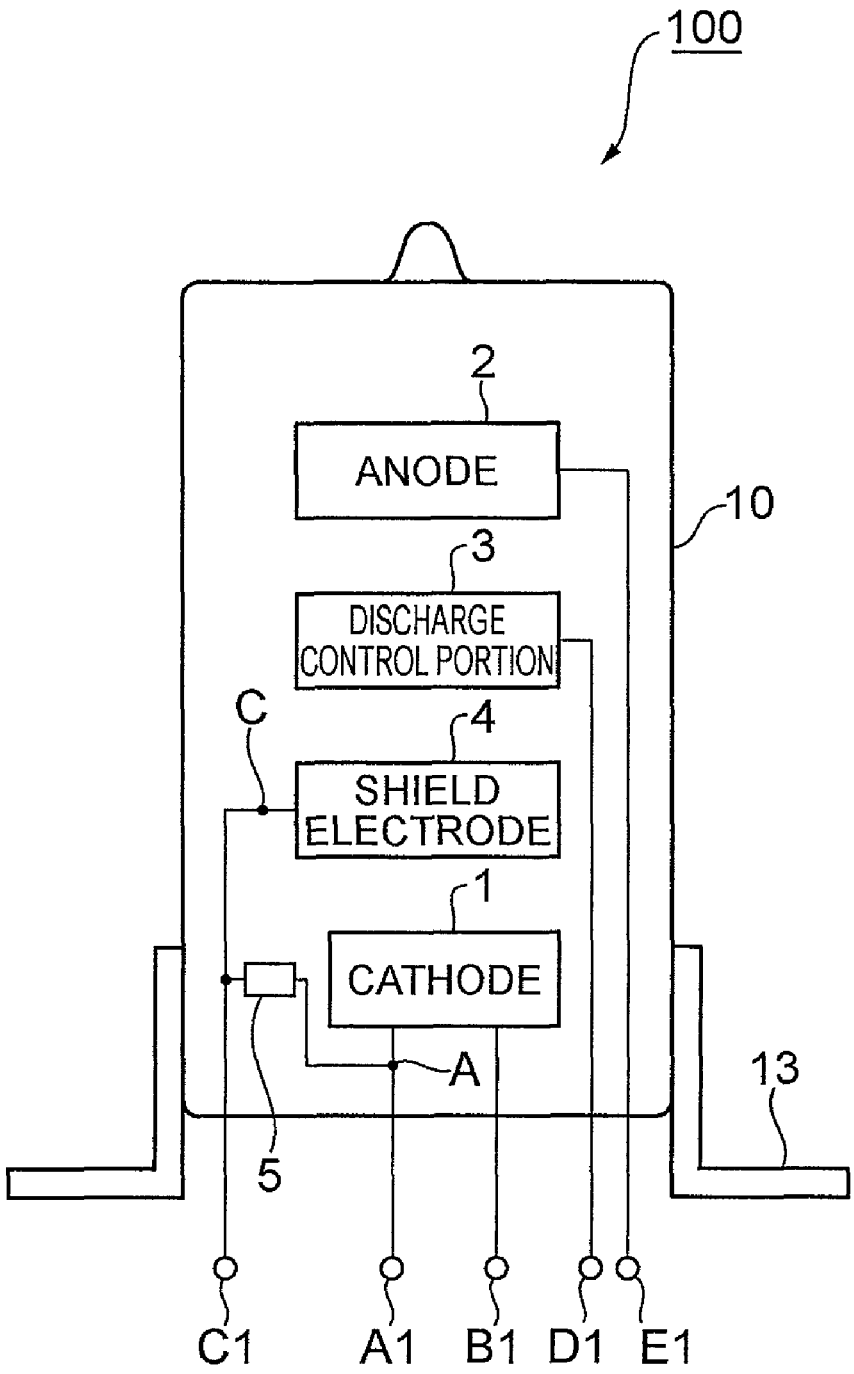
FIG. 15 is a schematic view of a discharge lamp including a potential control element inside of a sealed vessel.

FIG. 15 is a schematic view of a discharge lamp including a potential control element inside of a sealed vessel.

The above-described potential control element 5 can be disposed inside of the sealed vessel 10. The potential control element 5 is electrically connected between the support pin C connected to the shield electrode 4 and the cathode ground potential-side support pin A, and the potential control terminal 5, as the bidirectional voltage trigger switch 5X or the temperature-dependent switch 5G can be adopted.

FIG. 16 is a view showing a bidirectional voltage trigger switch.

As shown in the same figure, the above-described bidirectional voltage trigger switch 5X is, preferably, a semiconductor element formed by sequentially laminating a p-type semiconductor 5*a*, an n-type semiconductor 5*b*, a p-type semiconductor 5*c*, an n-type semiconductor 5*d*, and a p-type semiconductor 5*e*, composing a gateless bidirectional two-terminal thyristor. Both terminals thereof are conducted when a voltage therebetween exceeds a threshold value, and reach an insulated state to be disconnected when the voltage no longer exists therebetween. "SIDAC" (registered trademark) being an example of this element is switched over to a low on-state voltage via a negative resistance region when a voltage exceeding a standard break-over voltage is applied. The conduction continues until the current is shut off, or reaches the minimum holding current or less.

Although, in the present embodiment, a bidirectional voltage trigger switch is used, a voltage trigger switch such as a unidirectional voltage trigger switch may be used. Although, in this case, it becomes necessary to pay attention to the orientation of a connection thereof in manufacturing, this is not necessary in the case of a bidirectional voltage trigger switch, and therefore, it is more preferable in operation to use a bidirectional voltage trigger switch.

The invention claimed is:

1. A light source device comprising:
a sealed vessel filled with gas;
a cathode disposed in the sealed vessel;
an anode disposed in the sealed vessel;
an aperture member having a first opening located on a discharge path between the cathode and the anode;
a shield electrode having a second opening located on a discharge path between the cathode and the aperture member;
a support portion to which the shield electrode is fixed, the support portion being comprised of an insulator; and
potential control means for switching over potential of the shield electrode to either of a ground potential and a floating potential.

2. The light source device according to claim 1, wherein the potential control means includes:
a switch interposed between the shield electrode and ground potential; and
detection means for sensing a discharge state after an initial stage of a discharge start, and
connects the switch when the detection means does not sense the discharge state, and when having sensed, disconnects the switch.

3. A discharge lamp comprising:
a sealed vessel filled with gas;
a cathode disposed in the sealed vessel;
an anode disposed in the sealed vessel;
an aperture member having a first opening located on a discharge path between the cathode and the anode;
a shield electrode having a second opening located on a discharge path between the cathode and the aperture member;
a support portion to which the shield electrode is fixed, the support portion being comprised of an insulator; and
a potential control element for switching over potential of the shield electrode to either of a ground potential and a floating potential.

4. The discharge lamp according to claim 3, wherein the potential control element is a voltage trigger switch connected between the shield electrode and ground potential.

5. The discharge lamp according to claim 3, wherein the potential control element is a bidirectional voltage trigger switch connected between the shield electrode and ground potential.

6. The discharge lamp according to claim 5, wherein the bidirectional voltage trigger switch is a semiconductor element formed by sequentially laminating a p-type semiconductor, an n-type semiconductor, a p-type semiconductor, an n-type semiconductor, and a p-type semiconductor.

7. The discharge lamp according to claim 3, wherein the potential control element is a temperature-dependent switch that is connected between the shield electrode and ground potential and disconnected at a rise in temperature.

8. A discharge lamp comprising:
a sealed vessel filled with gas;
a cathode disposed in the sealed vessel;
an anode disposed in the sealed vessel;
an aperture member having a first opening located on a discharge path between the cathode and the anode;
a shield electrode having a second opening located on a discharge path between the cathode and the aperture member; and
a conductive member electrically connected to the shield electrode, wherein
potential of the conductive member is provided as a ground potential at an initial time of a discharge start, and then provided as a floating potential.

9. A control method for a discharge lamp comprising:
a sealed vessel filled with gas;
a cathode disposed in the sealed vessel;
an anode disposed in the sealed vessel;

an aperture member having a first opening located on a discharge path between the cathode and the anode; and a shield electrode having a second opening located on a discharge path between the cathode and the aperture member, said control method comprising:

a preliminary discharge step of providing potential of the shield electrode as ground potential in a period of an initial stage of a discharge start, while applying a trigger voltage between the cathode and the anode and between the cathode and the aperture member; and a main discharge step of applying a main voltage between the cathode and the anode, after the preliminary discharge step, while providing potential of the shield electrode as a floating potential.

* * * * *